US007602371B2

(12) United States Patent
Sultenfuss et al.

(10) Patent No.: US 7,602,371 B2
(45) Date of Patent: Oct. 13, 2009

(54) SYSTEM AND METHOD FOR PORTABLE INFORMATION HANDLING SYSTEM INTEGRATED BACKLIGHT CONTROL

(75) Inventors: Andrew T. Sultenfuss, Leander, TX (US); Christian L. Critz, Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 669 days.

(21) Appl. No.: 11/145,638

(22) Filed: Jun. 6, 2005

(65) Prior Publication Data

US 2006/0274023 A1 Dec. 7, 2006

(51) Int. Cl.
*G09G 3/36* (2006.01)

(52) U.S. Cl. ..... 345/102; 345/207; 345/690; 345/211; 349/65; 349/70; 362/561

(58) Field of Classification Search ..... 345/102, 345/205, 207, 690, 691, 211–213, 901; 349/58, 349/61, 65, 66, 70; 362/330, 561, 616, 26, 362/27, 31; 315/149, 292, 296
See application file for complete search history.

(56) References Cited

U.S. PATENT DOCUMENTS 5,953,074 A * 9/1999 Reddy ..... 348/558
6,812,649 B2 11/2004 Kim ..... 315/149
6,839,048 B2 1/2005 Park ..... 345/102
6,857,759 B2 2/2005 Lee et al. ..... 362/225
6,870,529 B1 * 3/2005 Davis ..... 345/207
6,930,898 B2 8/2005 Jeon et al. ..... 363/98
6,942,371 B2 9/2005 Chen ..... 362/561
7,136,076 B2 * 11/2006 Evanicky et al. ..... 345/600
7,236,154 B1 * 6/2007 Kerr et al. ..... 345/102
7,336,255 B2 * 2/2008 Nguyen et al. ..... 345/102
7,351,947 B2 * 4/2008 Dailey et al. ..... 250/214 AL

* cited by examiner

*Primary Examiner*—Henry N Tran
(74) *Attorney, Agent, or Firm*—Hamilton & Terrile, LLP; Robert W. Holland

(57) ABSTRACT

An information handling system inverter powers a display backlight at variable brightness levels determined by a brightness module integrated in the inverter. The brightness module sums a user interface setting, automated brightness setting and ambient light sensor measurement input into the inverter to determine the inverter power output, thus simplifying the integration of user brightness settings with automated brightness adjustments, such as DPST adjustments. A brightness range register holds maximum and minimum brightness settings for output by the brightness module. A calibration register holds a calibration brightness setting for calibration of display brightness.

20 Claims, 2 Drawing Sheets

SYSTEM AND METHOD FOR PORTABLE INFORMATION HANDLING SYSTEM INTEGRATED BACKLIGHT CONTROL

BACKGROUND OF THE INVENTION

1. Field of the Invention

The present invention relates in general to the field of information handling system displays, and more particularly to a system and method for portable information handling system integrated backlight control.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems configured as portable units have grown in popularity among users over the past several years. Portable information handling systems generally integrate in a single housing a display, internal power source and processing components, such as the CPU and hard disk drive, so that a user can carry the portable system from place to place while the system is operating. As processing components have decreased in size and increased in performance, portable information handling systems are often able to pack processing capabilities into a relatively small housing that are comparable to the capabilities available from desktop systems. One important consideration to achieving portability is reducing the power consumption of the components within the system so that the internal power will support operations for a long enough time period. Generally the most practical display solution for portable systems both in terms of size and power consumption are liquid crystal display (LCD) panels. LCD panels have a backlight, such as cool cathode florescent light (CCFL), that illuminates through a panel of pixels. An image is generated by altering the light-absorbing characteristics of the pixels so that backlight passing through a pixel has a desired color.

Although LCD panels provide an effective display solution for portable information handling systems, manufacturers still typically seek to reduce power consumption by the LCD panels as much as possible while presenting quality images from the panels. One example of an attempt to maintain display quality with reduced power consumption is the Display Power Saving Technology (DPST) available with Intel chipsets. DPST attempts to maintain the visual experience of a display with reduced backlight illumination by altering the image brightness and contrast for the colors within an image.

A graphics processing unit (GPU) provides incremental DPST adjustments to an inverter that powers the backlight so that the adjustments are not perceptible by a user. Users typically select the level of brightness for a display with manual inputs through a keyboard and that level of brightness is maintained relative to environmental conditions with an ambient light sensor (ALS) located in the panel. An embedded controller (EC) generally located in the base of the display accepts user inputs and ALS measurements to manage inverter output. However, the bus from the EC to the GPU and inverter is typically a single channel, such as a pulse width modulation (PWM) bus or an SMBus. Managing the adjustments to brightness by both the DPST and ALS through a common bus adds significant complexity to the generation of displays through analog to digital channels, processing, physical interface considerations and EC design and layout. Often substantial EC workloads impact display quality with delays also introduced by the narrow communication channel from the EC to the GPU.

SUMMARY OF THE INVENTION

Therefore a need has arisen for a system and method which more efficiently integrates multiple display control systems of an information handling system.

In accordance with the present invention, a system and method are provided which substantially reduce the disadvantages and problems associated with previous methods and systems for generating information handling system displays. Multiple brightness inputs are made at an inverter for use in determining the brightness of the backlight interfaced with the inverter. The multiple brightness inputs are summed at the inverter to determine illumination brightness based on multiple factors, such as manual user settings, automated brightness changes and sensed ambient light.

More specifically, an information handling system integrates processing components and a display in a portable housing so that the processing components generate information for presentation at the display. A backlight illuminates the display with varying brightness, the level of brightness determined by the power output from an inverter. A brightness module on the inverter determines the power output to the backlight by considering plural factors input to the inverter. One factor is a user input brightness level communicated by a user to the inverter through an embedded controller interface, such as with a SMBus or I2C bus. Another factor is automatic brightness adjustments, such as DPST adjustments determined by a graphics process and communicated to the inverter through a graphics controller interface and pulse width modulation bus. An ambient light sensor communicates ambient light measurements to the inverter through an ambient light interface. For example, the brightness module sums the values of the user input brightness setting, automated brightness adjustments and measured ambient light to set the power output from the inverter. The value output from the brightness module is constrained within a user-settable range and adjusted by a user-settable calibration value.

The present invention provides a number of important technical advantages. One example of an important technical advantage is that an embedded controller manages parameters for multiple display control systems by communicating information to registers of the inverter over a simple communication channel, such as a SMBus or I2C bus. Control of brightness at the inverter based on inputs from the embedded controller and ambient light sensor measurements provided to the inverter avoids applying ambient light sensor and DPST controls through timing and overhead alterations at the analog-to-digital and digital-to-analog conversion level. Users maintain direct control over display brightness while still benefiting from power savings of the automated display control provided by DPST.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Summing user brightness inputs and automated brightness adjustments at an inverter provides a desired brightness level from an information handling system display with reduced complexity. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
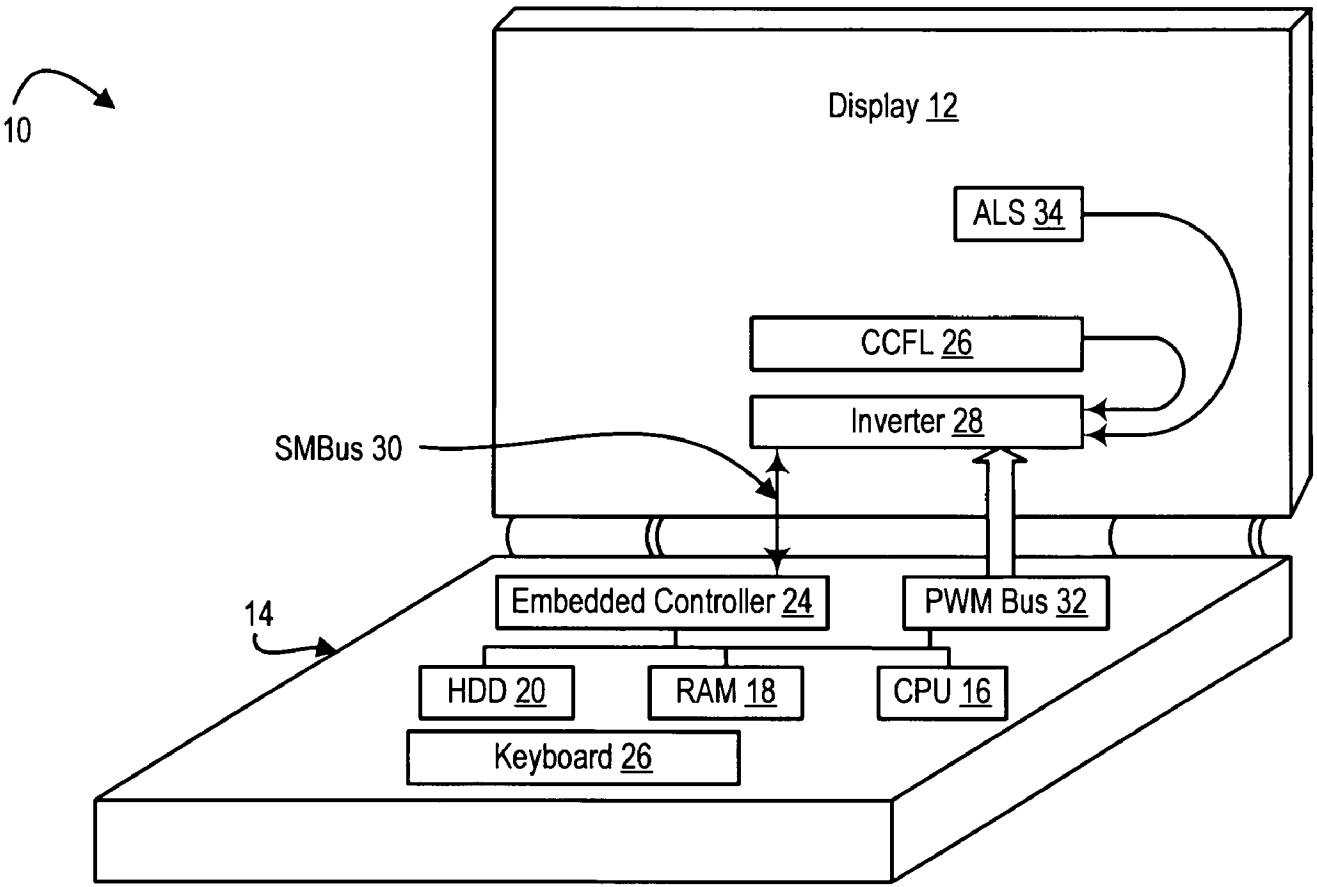
FIG. 1 depicts a block diagram of an information handling system configured to sum user brightness inputs and automated DPST brightness adjustments at an inverter.

Referring now to FIG. 1, a block diagram depicts an information handling system 10 operable to sum user brightness inputs and automated DPST brightness adjustments at an inverter. Information handling system 10 is configured as a portable system having a display 12 integrated in a housing 14 that contains processing components, such as a CPU 16, RAM 18, hard disc drive 20, graphics processor unit 22 and embedded controller 24. User inputs through input/output devices, such as keyboard 26, are detected at a physical layer by embedded controller 24 and provided to appropriate processing components. For instance, CPU 16 runs applications under user direction to generate information for presentation as images at display 12. Graphics processor unit 22 translates digital image information provided by CPU 16 into analog signals that alter the appearance of pixels of display 12. The image is presented at display 12 by illuminating the pixels with a CCFL backlight 26.

The brightness level of the illumination provided by backlight 26 is determined by an inverter 28 based on user brightness settings, automated brightness adjustments and an ambient light measurement. User brightness settings are manually input by the user at keyboard 26 or other input/output device and communicated to inverter 28 from embedded controller 24 through a control bus 30, such as a SMBus or I2C bus. Automated brightness adjustments are determined by graphics processor unit 22, such as in accordance with the DPST standard, and communicated to inverter 28 through a pulse width modulation bus 32. An ambient light sensor 34 detects the level of ambient light at display 12 and provides the ambient light measurement to inverter 28 for adjustment of backlight illumination in response to external lighting conditions. Directly interfacing each of graphics processor unit 22, embedded controller 24, and ambient light sensor 34 to inverter 28 allows inverter 28 to determine the power output to backlight 26 with both automated and manual settings without converting the settings through analog-digital conversion at the graphics processor 22.

Figure 2:
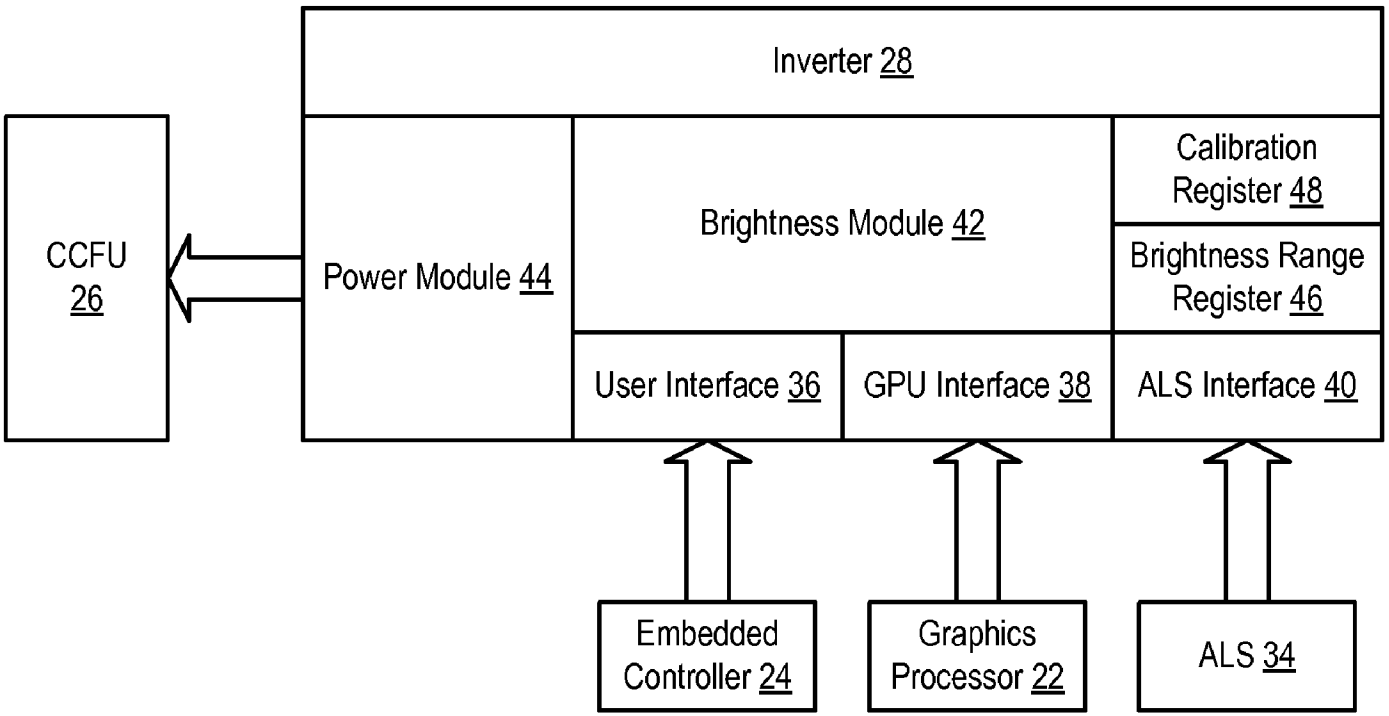
FIG. 2 depicts a block diagram of an information handling system inverter having manual and automated brightness setting inputs.

Referring now to FIG. 2, a block diagram depicts an information handling system inverter 28 having manual and automated brightness setting inputs. Embedded controller 24 provides manual user brightness settings to a user interface 36, graphics processor 22 provides automated brightness settings to a graphics processor interface 38, and ambient light sensor 34 provides ambient light measurements to ALS interface 40. The user brightness setting, automated brightness setting and ambient light measurement are summed at a brightness module 42 to determine the power output by a power module 44 to backlight 26. For instance, a user manual input to increase brightness will add to the power level output by brightness module 42. Similarly, automated adjustments to brightness, such as incremental changes performed in accordance with the DPST standard, automatically alter the sum of the brightness module to effect brightness output. Increases and decreases in ambient light measured by sensor 34 results in an appropriate change to the sum of brightness module 42 to manage the presentation of the image in varying lighting environments. By performing the summing at inverter 28 instead of embedded controller 24 or graphics processor 22, brightness module 42 reduces the workload of those devices.

User brightness settings also include range and calibration constraints defined to control the operating conditions of inverter 28. For example, a brightness range register 48 stores user-settable minimum and maximum brightness levels. Brightness module 42 compares the summed values of the output brightness against the minimum and maximum values to keep the value output to power module 44 within the minimum and maximum values. A calibration register 48 allows calibration of the power output so that backlight 26 illuminates at a desired value. For initial calibration, brightness module 42 illuminates at a calibration value stored in calibration register 48. Illumination of backlight 26 is measured at the calibration output to adjust the calibration value so that an unadjusted brightness output has a predetermined brightness. The value in calibration register 48 is then used to adjust the sum of brightness module 42 so that the calibration value acts as a base value to which user input, automated and sensed light adjustments are made.

Although the present invention has been described in detail, it should be understood that various changes, substitutions and alterations can be made hereto without departing from the spirit and scope of the invention as defined by the appended claims.

What is claimed is:

1. An information handling system comprising:

a housing;

plural processing components disposed in the housing and operable to process information;

a display integrated in the housing, the display having a backlight and pixels, the backlight illuminating the pixels to present images formed with the information;

an inverter operable to power the backlight;

a controller interfaced with the inverter and operable to accept user brightness settings;

a graphics processor interfaced with the inverter and operable to generate automated brightness adjustments;

a light sensor interfaced with the inverter, the light sensor operable to detect ambient light to provide an ambient light brightness correction; and a brightness module integrated in the inverter and interfaced with the controller, the graphics processor and the light sensor, the brightness module operable to sum the user brightness setting, the automated brightness adjustment and the ambient light brightness correction to determine a power output from the inverter to the backlight.

2. The information handling system of claim 1 further comprising brightness range settings stored at the brightness module, the brightness range settings defining maximum and minimum values for the power output from the inverter to the backlight.

3. The information handling system of claim 1 further comprising a calibration setting stored at the brightness module and operable to defined a predetermined power output from the inverter to the backlight.

4. The information handling system of claim 1 wherein the graphics processor communicates automated brightness adjustments to the inverter through a pulse width modulation bus.

5. The information handling system of claim 4 wherein the automated brightness adjustments comprise DPST adjustments.

6. The information handling system of claim 1 wherein the controller communicates user brightness settings to the inverter through a SMBus.

7. The information handling system of claim 1 wherein the controller communicates user brightness settings to the inverter through an I2C bus.

8. A method for setting inverter output to an information handling system display backlight, the method comprising:

receiving user brightness settings at the inverter;

receiving automated brightness adjustments at the inverter;

receiving ambient light measurements at the inverter; and summing the user brightness settings, automated brightness adjustments and ambient light measurements at the inverter to determine a power output from the inverter to the backlight.

9. The method of claim 8 further comprising:

setting a brightness range for the power output from the inverter to the backlight; and forcing the sum of the user brightness settings, automated brightness adjustments and ambient light measurements to remain within the brightness range.

10. The method of claim 8 further comprising:

setting a calibration adjustment at the inverter; and including the calibration adjustment in the summing.

11. The method of claim 8 further comprising:

forcing user brightness settings, automated brightness adjustments and ambient light measurements to zero;

outputting power from the inverter to the backlight at a calibration adjustment;

comparing the backlight brightness with a predetermined brightness; and setting the calibration adjustment to output the predetermined brightness.

12. The method of claim 8 wherein receiving user settings further comprises:

receiving user inputs at a controller to adjust the brightness of the backlight; and sending the user inputs from the controller to the inverter through a SMBus.

13. The method of claim 8 wherein receiving user settings further comprises:

receiving user inputs at a controller to adjust the brightness of the backlight; and sending the user inputs from the controller to the inverter through an I2C bus.

14. The method of claim 8 wherein receiving automated brightness adjustments further comprises:

generating the automated brightness adjustments with a graphics processor; and sending the automated brightness adjustments from the graphics processor to the inverter through a pulse width modulation bus.

15. The method of claim 14 wherein the automated brightness adjustments comprise DPST adjustments.

16. An inverter for powering a backlight at variable brightness settings, the inverter comprising:

a user interface operable to accept user brightness settings;

a graphics processor interface operable to accept automated brightness adjustments of a graphics processor;

an ambient light sensor interface operable to accept ambient light measurements;

a brightness module operable to sum the user brightness setting, automated brightness adjustments and ambient light measurements to determine a brightness output setting; and a power module operable to output variable power levels to a backlight to provide illumination from the backlight having the brightness output setting.

17. The inverter of claim 16 further comprising a brightness range register defining a maximum and minimum brightness output setting range, the brightness module further operable to force the brightness output setting to stay within the maximum and minimum brightness output setting range.

18. The inverter of claim 16 further comprising a calibration register defining a calibration brightness output setting, the brightness module further operable to force the brightness output setting to the calibration brightness output setting for calibration of a display.

19. The inverter of claim 16 wherein the user interface comprises a SMBus.

20. The inverter of claim 16 wherein the graphics processor interface comprises a pulse width modulation bus.

* * * * *

UNITED STATES PATENT AND TRADEMARK OFFICE

CERTIFICATE OF CORRECTION

PATENT NO. : 7,602,371 B2
APPLICATION NO. : 11/145638
DATED : October 13, 2009
INVENTOR(S) : Sultenfuss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 922 days.

Signed and Sealed this

Fifth Day of October, 2010

David J. Kappos

David J. Kappos
*Director of the United States Patent and Trademark Office*